United States Patent [19]

Milman

[11] Patent Number: 4,935,976

[45] Date of Patent: Jun. 26, 1990

[54] CRIB CONSTRUCTION

[76] Inventor: Sherry C. Milman, 2953 Shore Dr., Merrick, N.Y. 11564

[21] Appl. No.: 418,743

[22] Filed: Oct. 3, 1989

Related U.S. Application Data

[63] Continuation of Ser. No. 229,228, Aug. 5, 1988, abandoned.

[51] Int. Cl.[5] ..... A47D 7/00

[52] U.S. Cl. ..... 5/93 R; 5/280; 5/53 R; 5/508; 446/227

[58] Field of Search ..... 5/280, 93 R, 99 C, 53 R, 5/508; 446/227

[56] References Cited

U.S. PATENT DOCUMENTS

| | | | |
|---|---|---|---|
| 153,335 | 4/1949 | Brand | 5/93 R |
| 571,768 | 11/1896 | Jones | 5/280 |
| 2,524,483 | 10/1950 | Shealey | 5/99 C |
| 2,687,537 | 8/1954 | Wallace | 5/280 |
| 2,689,960 | 9/1954 | Lax | 5/93 R |

FOREIGN PATENT DOCUMENTS

| | | | |
|---|---|---|---|
| 19371 | of 1907 | United Kingdom | 5/280 |

*Primary Examiner*—Gary L. Smith
*Assistant Examiner*—Michael Milano
*Attorney, Agent, or Firm*—Bauer & Schaffer

[57] ABSTRACT

A bedstead such as a child's crib having a headboard provided with a plurality of openings into which interchangeable inserts fit which and are securely. The interchange of selected inserts provide a variety of educational information and amusements to the child.

6 Claims, 1 Drawing Sheet

Fig. 1
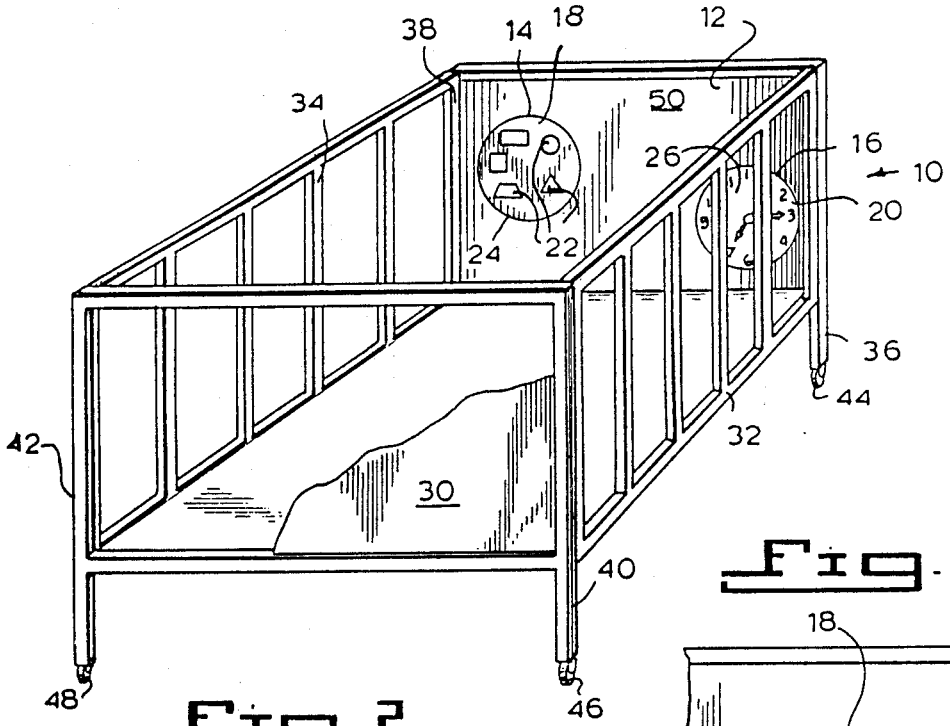
Fig. 2
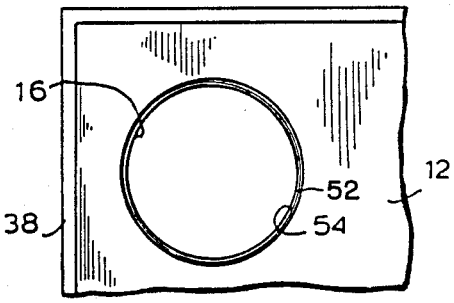
Fig. 3
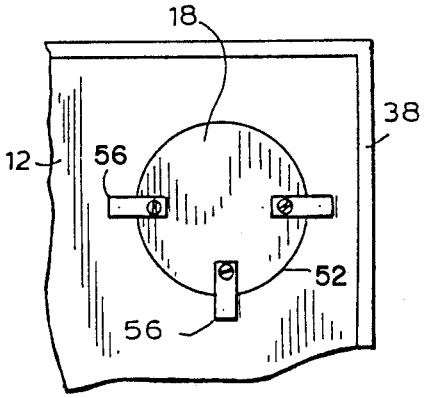
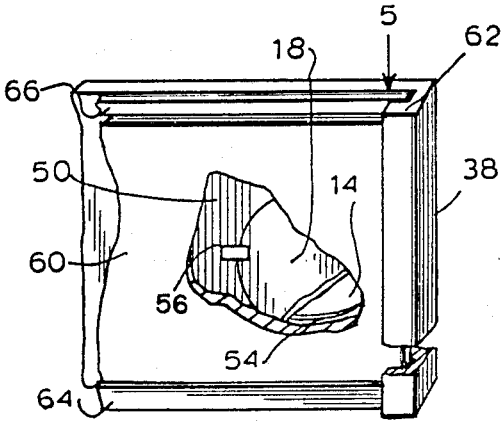
Fig. 4
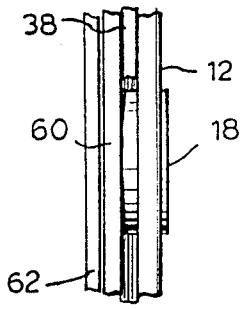
Fig. 5

CRIB CONSTRUCTION

This is a continuation of Ser. No. 229,228, filed Aug. 5, 1988, now abandoned.

This invention relates to a an infant crib or bed and particularly to a headboard or footboard of a child's bed or play pen which includes an educative or play insert.

BACKGROUND OF THE INVENTION

A wide variety of headboards and bedsteads are known, which include novelty devices for the amusement of an infant or child. Examples of such headboards and bedsteads are disclosed in U.S. Pat. No. 3,736,603, which deals with a child's plush figure headboard, and U.S. Pat. Nos. Des. 252,599; 264,773; 266,806; and 267,839 which deal with fanciful novelty headboard and/or footboard designs and bedsteads. There exists, however, a need for further devices of this type which provide not only a unique endboard but which also includes an insert utilized in cooperation therewith. The present invention fulfils such a need.

BRIEF STATEMENT OF THE INVENTION

In accordance with the invention, there is provided a bedstead such as a crib or child's play pen or the like having a headboard and/or a footboard panel provided with at least one shaped opening into which is disposed an insert having front and rear surfaces and which conforms in shape to the opening. The insert consists of an educative or amusement device located on the front surface, facing towards the interior of a bedstead so that it may be viewed, manipulated, or played with by an infant or child. Means are provided for preventing the insert from passing forwardly into the interior of the bedstead and from falling rearwardly out of the opening, yet being easily removable for replacement and exchange with other inserts.

In order to understand the present invention more fully, reference is directed to the accompanying drawings which are to be taken in conjunction with the following detailed description of the invention.

THE DRAWINGS

In the drawings:

FIG. 1 is a view in perspective of a bedstead having an endboard in accordance with the invention with two inserts disposed in openings therein;

FIG. 2 is a partial view in elevation of the endboard illustrated in FIG. 1 with the insert removed;

FIG. 3 is a partial view in elevation and from the rear of the endboard illustrated in FIG. 1 with the insert in place in the opening of the endboard and showing the disposition of the retaining tabs;

FIG. 4 is a partial view in elevation and taken from the rear of the endboard illustrated in FIG. 1 with the insert in place and a backing cover disposed thereover; and FIG. 5 is a partial side view in elevation of endboard shown in FIG. 4 and taken across line 5—5 of FIG. 4.

DESCRIPTION OF THE PREFERRED EMBODIMENTS

While the present invention is hereafter described in connection with a child's crib, it will be appreciated that the same principles and construction can be applied to a play pen or other child enclosure.

Referring now more particularly to FIG. 1, a bedstead such as an infant crib, generally depicted by the numeral 10, is provided with a endboard panel here serving as the headboard 12. The headboard 12 is provided with at least one opening. Here, two openings 14 and 16 are shown, each having disposed therein an insert 18 and 20, respectively, illustrating the various types of educational or play elements which can be supplied. For example, insert 18 is formed with geometric blocks such as 22 which are slightly force fitted into openings (not shown) in the front face 24 thereof. On the other hand, insert 20 is provided with a clock on its front face 26. The inserts are arranged above the mattress of the crib, in sight of and at a height to be manipulated by the infant as the infant grows.

The inserts 18 and 20 may be constituted from a wide variety of educative material other than those shown in FIG. 1 such as, for example, including an alphabet, a series of numbers, a plurality of colors, a plurality of animal likenesses, a plurality of nursery songs, and/or rhymes, a plurality of transportation means such as automobiles, trucks, trains, and planes or the like. The inserts may also be mechanical or electrical devices, clocks, radio devices, music boxes, etc. It is to be understood that the present invention is not limited by the type of educational or play means employed.

Bedstead 10 also includes a footboard 30 connected thereto by side members or rails 32 and are provided side bars 34, at least one of which can be lowered in order to more easily place or remove the infant. Headboard 12 and footboard 30 are each supported on paired, spaced vertical legs 36 and 38 and 40 and 42, respectively, which form a frame therefor. The legs are provided with castors 44, 46, and 48 or wheels or feet of some sort. As further shown in FIG. 1, both headboard 12 and footboard 30 are formed of a rigid sheet panels 50 through which the openings 14 and 16 are made. The panels have front and rear surfaces which may be decorated as desired. On the other hand, the "boards" may be made in part or whole of slats, rails, filigree or the like, provided suitable openings for the inserts can be fashioned. It is to be understood that although the footboard is shown as not having any inserts disposed therein since it faces away from the viewer in the drawings, it may have such elements just as are disposed in the headboard.

The inserts 18 and 20 conform in shape to that of the openings 14 and 16 into which they are disposed. The openings may be circular as shown, oval, square, or polygonal as desired. Although it is not critical, it is preferred that the insert have an operative thickness within the opening equal to the thickness of the "board" in which the opening is made, thereby providing strength and uniformity to the headboard or footboard.

The various elements of the bedstead may be made from a wide variety of materials such as wood, plastics, and even metals, although wood and plastics are preferred. Still further, the inserts may be made of the same material but are preferably made of plastic.

Now, as may be seen from FIG. 2, in one form of the invention the rear edge 52 of the opening 14 or 16 is provided with a bevelled periphery to form a bezel 54 on the front surface to allow the insert 20 to seat firmly therein and to prevent the insert disposed therein from falling into the interior of bedstead 10. In a second form shown in FIG. 3 a plurality of tabs 56 are secured, as by screws or the like, to the rear surface of the insert 18 to prevent the insert from falling into the bedstead 10. The tabs 56 may be used in lieu of or together with the bevelled edge 54.

It is also to be understood that other means for holding the insert in the opening can be used. Such means may take the form of one or more separate bezel elements, screw fasteners, wedges, or the like. The interesting factor, however, lies in the provision of means which prevent only the forward passing of the insert through the endboard, thus allowing the insert to be removed easily from the rear, and avoiding any use of fastening element such as screws, tabs, or the like on the front or interior face of the endboard panel 50.

The rear surface of the headboard or footboard is provided, additionally, with a cover such as a backing 60 which may be made of similar materials as the sheet panel 50 is and of equal or even lesser thickness. The backing 60 serves to hide the rear of the opening, the insert and, if used, the tabs so that the bedstead retains is attractive appearance even from the rear. More importantly the backing 60 acts to hold the insert 18 or 20 within its opening 14 or 16 by contact with its rear surface so that the insert will not fall rearwardly and cannot be pushed rearwardly by a child. In this manner the insert is held firmly during use but can be easily removed and replaced by an adult.

To hold the backing member 60 the paired legs 36 and 38 and 40 and 42, associated with the bedboard, having the openings 14 or 16, are provided on their rear surface with slotted rails 62 (FIG. 4) into which the edges of the backing 60 slide from the top down. A stop rail 64 is provided transversely below the bottom or mattress level of the bedstead to hold the backing 60 at a given height and position, and an upper removable rail 66 may also be used to prevent unauthorized removal of the backing 60. In the alternative, the backing 60 may be hinged along on the vertical edge of the legs as by using a conventional piano hinge, and by providing simple latch means on the opposite leg to hold the backing in place. Thus, the backing is openable like a door to gain access to the rear of the inserts. Of course, in more economical constructions, the inserts 18 or 20 may be held, for example, by screwing the tabs onto the rear surface of the endboard or by applying less than whole sheets of backing over the insert, or by employing bezel means about the edge of the insert. Similarly, the manner of applying the backing, if used, can take many other forms.

The bedstead employing the endboard and inserts described above presents many advantages. For example, it provides a totally educational bedstead with replaceable amusement and educational inserts. Moreover, while the inserts shown are primarily directed to simple arrangements which may be used by a child, they can easily be substituted with more difficult arrangements as the child grows and may even be replaced by elements which are adult oriented. Still further, the inserts may be provided with musical programs powered by a battery located therein or provided with moveable parts such as wheels or the like, which can move or turn under battery power. Cassettes can be disposed therein which are likewise powered. In such cases, appropriate switches may also be provided to turn the power on and off as described. Numerous other advantages of the structures of this invention will be apparent to those skilled in the art. The concept of rails or hinges such as shown to support the backing may be employed also to hold the sheet panel 50 to the frame formed by the paired legs so that even these panels 50 can be removed, opened, or even exchanged from the front of the endboards. This permits the exchange of decorative sheet panels 50 as well as of the inserts quite readily and allows the crib to "grow" with the child by providing more elaborate panels. The removability of the panels also allows the panel to be used independently of the crib, for example, as a free-standing or wall-mounted member, when the crib is no longer in use.

It is to be understand, therefore, that this invention is not to be limited to the described embodiments thereof, except as defined in the appended claims.

What is claimed is:

1. An endboard adapted for use as a headboard or a footboard of a bedstead provided with an educational or amusement module comprising a vertical frame and rigid panel fixed within said frame, said panel having planar front and rear surfaces and a plurality of discretely shaped openings, each of a size substantially less than that of the entire panel and spaced from each other, a distinctive educational or amusement module located in each of said openings, each of said modules having a periphery conforming in shape to its respective opening and having a thickness such that its front and rear surfaces conform substantially to the front and rear surfaces of the panel, and means for removably securing each of said modules in their respective openings, including first means attached to said module for preventing said module from passing through said opening into the interior of said bedstead, and second means for preventing said module from passing out of said opening rearwardly of said endboard.

2. The endboard according to claim 1, wherein said first means retaining said module in said opening comprises cooperating bevels and edges about the edge of said module and said opening respectively.

3. The endboard according to claim 1, wherein said first means for preventing said module from passing through the front of said endboard comprising at least one tab extending outwardly from the rear surface of said module over the adjacent edge of the rear surface of said endboard and said second means comprises a fastener attaching said tab to said panel.

4. An endboard adapted for use as a headboard or a footboard of a bedstead, play pen, or the like, said endboard having front and rear surfaces and side edges comprising at least one shaped opening in said endboard, an insert removably disposed within aid opening and having front and rear surfaces and conforming in shape to said opening, said insert being provided with a distinctive educational or amusement module located on the front surface thereof facing towards the interior of a bedstead, said endboard and said insert having cooperating means for preventing said insert from passing out of the front of said opening, a planar backing sheet supported by a vertical slot formed respectively adjacent each of the side edges of said endboard, said backing sheet being slidable in said slots to removably cover said insert.

5. An endboard adapted for use a headboard or a footboard of a bedstead, said endboard comprising a pair of spaced vertical legs defining a frame and a rigid panel having front and rear surfaces, said panel being removably attached within said frame, bridging the legs to define the main portion of said endboard, at least one shaped opening formed in the main portion of said panel, an insert disposed in said opening and having front and rear surfaces and conforming in shape to said opening with at least one educative or play material located on the front surface thereof facing towards the interior of said bedstead, said insert being prevented from passing out through the front of said opening and means for removably holding said insert from the rear comprising a vertical slot formed in each of the spaced vertical legs of the headboard and a rigid planar member disposed over the rear surface of the headboard riding in said slots.

6. The endboard according to claim 5 provided with a plurality of openings in the headboard and a plurality of inserts disposed in said opening.

* * * * *